US008378192B1

(12) United States Patent
Harmon

(10) Patent No.: US 8,378,192 B1
(45) Date of Patent: Feb. 19, 2013

(54) PORTABLE GUITAR WITH AN ADJUSTABLE BOTTOM LEG REST SECTION

(76) Inventor: Thomas H Harmon, Vancouver, WA (US)

( * ) Notice: Subject to any disclaimer, the term of this patent is extended or adjusted under 35 U.S.C. 154(b) by 279 days.

(21) Appl. No.: 12/803,149

(22) Filed: Jun. 21, 2010

(51) Int. Cl.
*G10D 3/00* (2006.01)

(52) U.S. Cl. ..... 84/291; 84/327

(58) Field of Classification Search ..... 84/291
See application file for complete search history.

(56) References Cited

U.S. PATENT DOCUMENTS 1,945,162 A * 1/1934 Rasmussen ..... 84/327
4,592,265 A * 6/1986 Steinberger ..... 84/327
4,966,062 A * 10/1990 Driggers et al. ..... 84/327
5,315,910 A * 5/1994 Soupios ..... 84/453
5,682,003 A * 10/1997 Jarowsky ..... 84/267
6,573,439 B2 * 6/2003 Wilson ..... 84/291
7,205,468 B1 * 4/2007 Johnson ..... 84/327
7,371,949 B2 * 5/2008 Sawhney et al. ..... 84/291
2008/0196572 A1 * 8/2008 Navarro ..... 84/327

* cited by examiner

*Primary Examiner* — Christopher Uhlir

(57) ABSTRACT

A portable travel guitar that can be readily disassembled to fit into a compact custom guitar case. The top and bottom sections of the guitar body are detached from the main body of the guitar which streamlines it's size. The bottom section which comprises a typical cut out that accommodates resting a standard guitar on a performers leg or knee, can be moved forward or rearward and secured into position. The assembly and disassembly as well as the leg rest adjustments requires no tools.

1 Claim, 4 Drawing Sheets

PORTABLE GUITAR WITH AN ADJUSTABLE BOTTOM LEG REST SECTION

FIELD OF INVENTION

This invention relates in general to a guitar, and more particularly to a portable guitar with an adjustable leg rest section.

This invention relates to a guitar, and it's ability to be a compact and portable guitar with an adjustable bottom leg rest section (regardless by what means it can be adjusted and secured into position) of the body.

BACKGROUND OF INVENTION

The existence of electric guitars have been around since the 1930's. Over the decades many electric guitars have been designed with different shapes and configurations. Some with solid bodies and others with hollow bodies. It has been noted that any guitar in it's assembled state with a neck, body, and strings, has been often difficult to transport because of it's large and awkward size.

It has also been apparent, that because of various reasons, many performers have found that the standard position of playing a guitar has been uncomfortable.

Leg rest inventions that are designed for use on guitars are often, an entirely separate entity of the guitar which in some cases may require the unit to be fastened to the guitar with screws or bolts, thus damaging the guitar.

This drawback is depicted in Wilson, U.S. Pat. No. 6,703,546. Also Wilson's invention only allows the leg rest to be rotated in a limited fashion, and does not allow the position of the guitar to move forward or rearward from it's fixed location. This apparatus is attached to the body of the guitar with screws.

Another leg rest application with a particular drawback is depicted in Shaw, U.S. Pat. No. 5,058,479. Wherein Shaw has incorporated a leg rest in his design, but it locks into only one horizontal position.

As a compact travel guitar, it is also noted that some art, such as Shaw U.S. Pat. No. 5,058,479 illustrates wing sections (16 and 17) that slides onto the body of the guitar using what is referred to as a "keyhole" shaped guide members (40 and 41). Depending on the material used, heat, cold, and humidity can deform such a small channel or opening, eventually rendering this application inoperable. There appears to be such a large number of small parts, made with various materials, that any one or several parts could become deformed, and pull the narrow keyhole guide out of alignment, thus preventing the wings section (16 and 17) from sliding on the main body.

SUMMARY OF THE INVENTION

Briefly according to the invention, there is provided a portable guitar with an adjustable bottom section. The fact that the top and bottom sections are removable, enables the guitar to be packed into a smaller case, thus enabling the guitar to be easily stored on a plane, in a car, or on a bus. This will enable the guitar to be used as a canyon. Because it is an electric guitar it can be very quiet and can be played with privacy in a hotel room.

A principal object of this invention is to enable the guitar player the ability to adjust the position of the guitar more forward or rearward when resting the guitar on either the knee or the leg while in a sittingposition. This will accommodate a guitar player who has difficulty for any reason in finding a comfortable position while performing.

This adjustment is accomplished by sliding the bottom section of the guitar that already rest on a players knee or leg, more forward or rearward. This is easily accomplished by loosening the thumb disk screw which passes through the slot on the mounting face of the bottom section. Once the bottom section is in the desired position simply tighten the thumb disk screw to secure the bottom section in place.

The principal object of the present invention is to provide a guitar that can be played more easily as a result of adjusting the bottom section in a more comfortable position. This instrument will play, and sound like a regular high quality guitar.

Another object of this invention is to enable the guitar to detach the top and bottom sections of the body from the main body section so it will fit into a smaller and more compact case. This will make it easier to carry and stow away for home or travel.

Another object of this invention is the ability to adjust the position of the bottom leg rest section or to detach the top section and the bottom section without the need of tools.

DESCRIPTION OF PREFERRED EMBODIMENTS

The guitar body is fabricated from various types of materials. The main body section is comprised of wood, whereas the top and bottom sections may use a combination of wood, acrylic, ABS, or various metals.

This guitar can be used with an amplifier for performance use, or when necessary to be in places where low volume is essential, a portable headphone amplifier can be used.

Unlike other travel guitars with removable necks, this guitar uses a neck that is permanently mounted to the guitar body.

This eliminates the cumbersome need to wrap and store the strings, and to carry tools in order to detach the neck. Yet this guitar will pack neatly in a much smaller custom built case, as compared to existing guitar cases traditionally used.

In the current invention, the process for disassembly enables both the top section and the bottom section to be separated from the main body section. This is well illustrated in FIG. 7. Detachment of the top and bottom sections is accomplished by unscrewing the thumb disk screws which holds them in place. No tools are required to assemble or disassemble the guitar body. Nor are there tools necessary to adjust the bottom section when needed.

Figure 1:
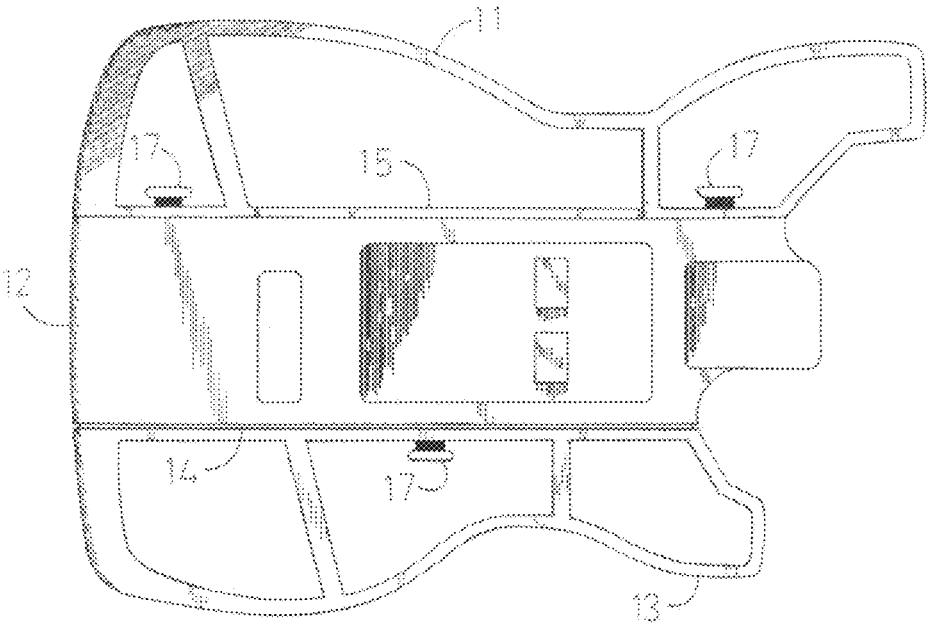
FIG. 1 shows the front plan view of the guitar body in it's assembled state according to a preferred embodiment of the present invention.

FIG. 1 shows the front plan view of a preferred embodiment as it relates to a guitar body. The basic components of this guitar body is the top section 11, the main body section 12, and the bottom section 13. Both the top section 11, and the bottom section 13, are attached to the main body section 12, with thumb disk screws 17. Two thumb disk screws are used to secure the top section 11, and one is used to secure the bottom section 13.

Figure 2:
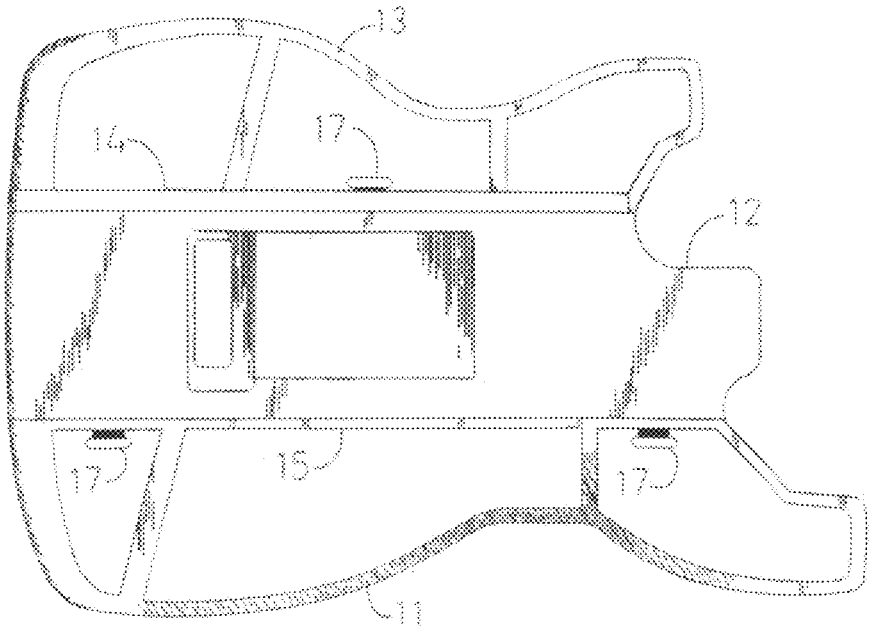
FIG. 2 shows the back plan view of the guitar body in it's assembled state according to a preferred embodiment of the present invention.

FIG. 2 illustrates the back plan view of the guitar body. The same integral components can be seen in this view as in the front plan view. The flange part of the slide guide 14 is clearly seen in this view, and is used in order to allow the bottom section 13 to slide easily forward and rearward while maintaining it's parallel and perpendicular position to the main body section 12 of the guitar. The slide guide 14 is permanently attached to the main body section 13, and is not removed when disassembling the guitar for transport.

Figure 3:
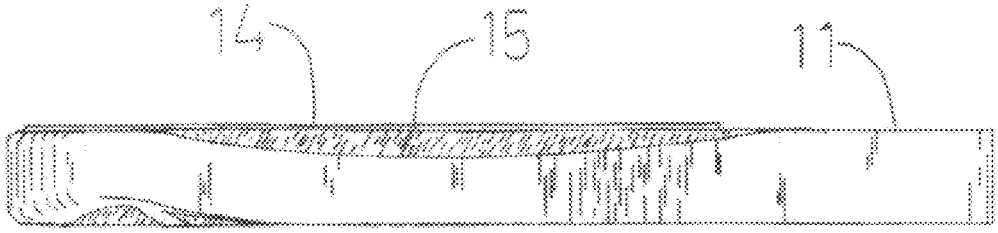
FIG. 3 shows the top view of the guitar body in it's assembled state according to a preferred embodiment of the present invention.

FIG. 3 is a top view of the guitar body in it's assembled state. The components displayed in this view is the slide guide 14, the control panel 15, and the top section 11. The control panel is permanently mounted to the main body section 12, and is also shown in FIG. 1.

Figure 4:
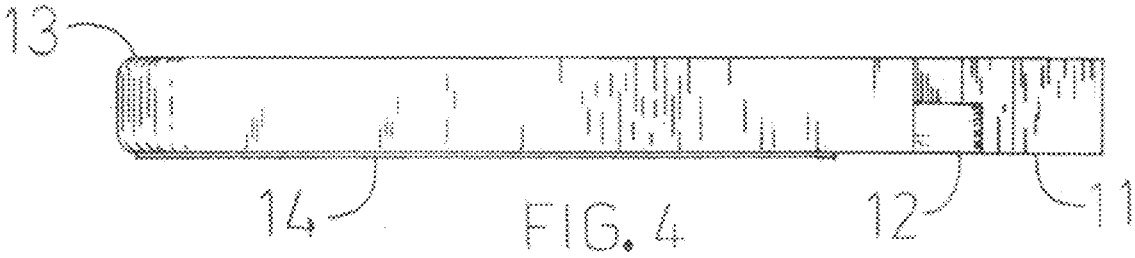
FIG. 4 shows the bottom view of the guitar body in it's assembled state according to a preferred embodiment of the present invention.

FIG. 4 is a bottom view of the guitar body in it's assembled state. Shown here in this view is the top section 11, the main body section 12, the bottom section 13, and the slide guide 14.

Figure 5:
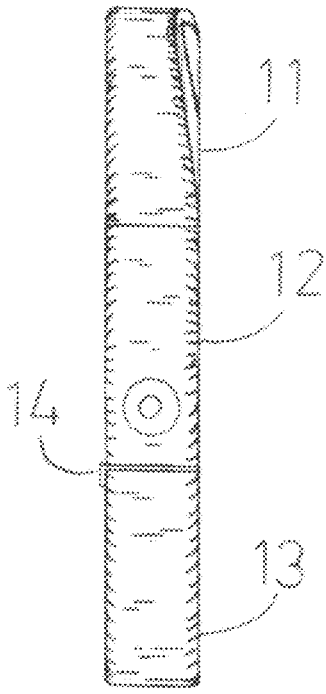
FIG. 5 shows the rear end view of the guitar body in it's assembled state according to a preferred embodiment of the present invention.

FIG. 5 is the rear end view of the guitar body in it's assembled state. Displayed here is the top section 11 as it is mounted to the main body section 12. Also shown is the slide guide 14, as it relates to the main body section 12, and the bottom section 13.

Figure 6:
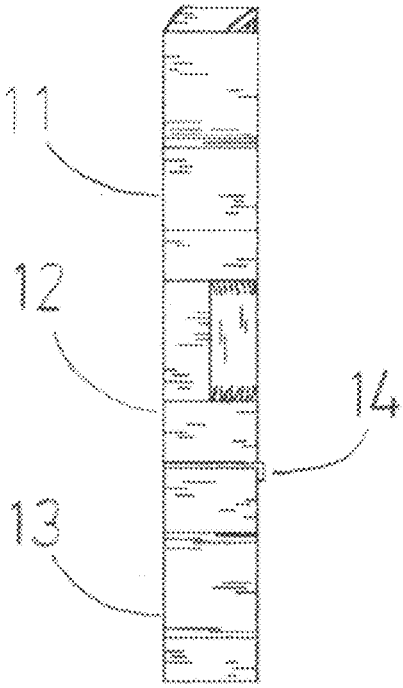
FIG. 6 shows the neck end view of the guitar body in it's assembled state according to a preferred embodiment of the present invention.

FIG. 6 is the neck end view of the guitar body in it's assembled state. Displayed here is the top section 11, as it is mounted to the main body section 12. Also shown is the slide guide 14, as it relates to the main body section 12, and the bottom section 13.

Figure 7:
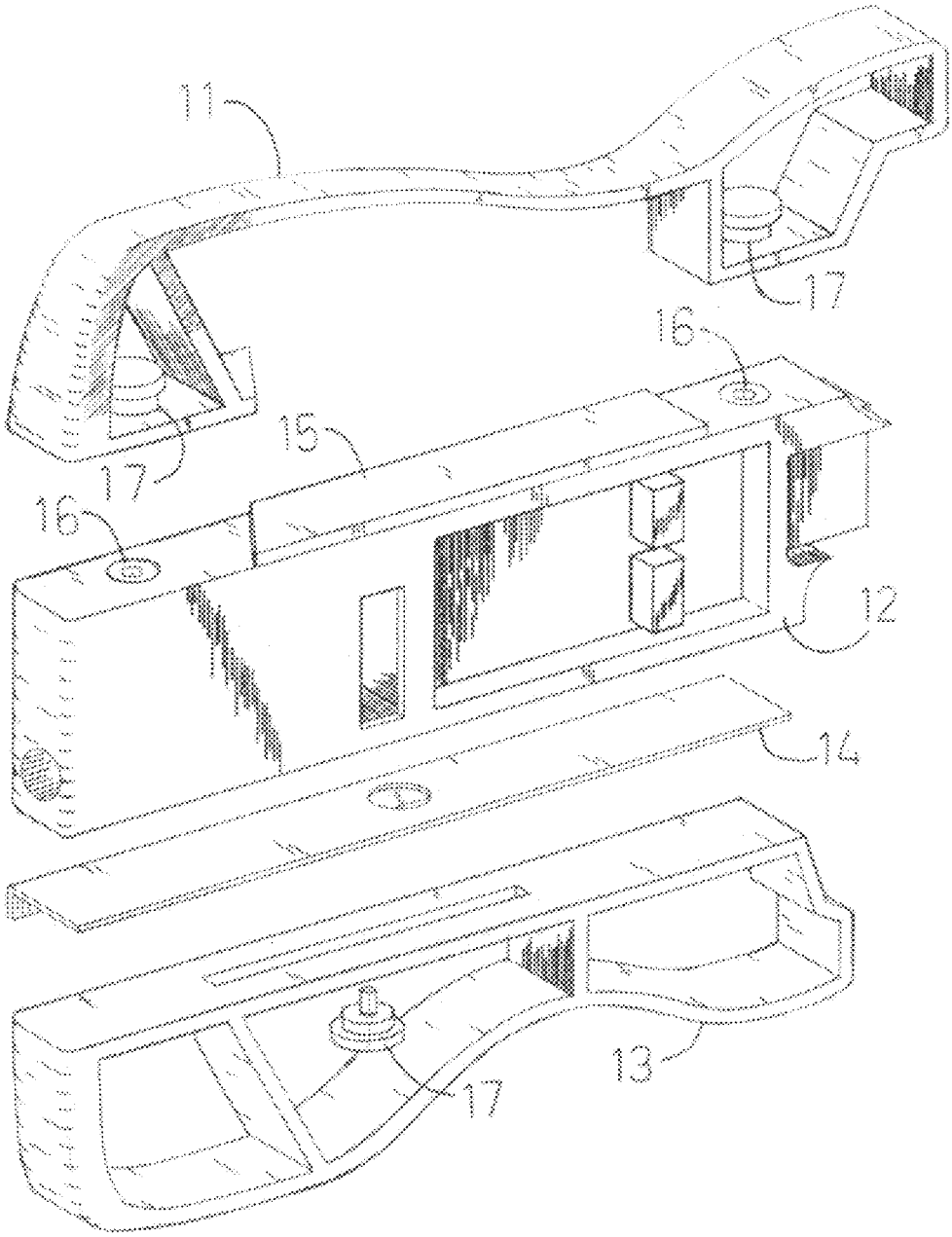
FIG. 7 shows the exploded view of the guitar body in it's assembled state according to a preferred embodiment of the present invention.

FIG. 7 is an exploded view of the guitar body in it's assembled state. The top section 11 is shown here with the thumb disk screws 17 in place. As the top section is secured to the main body section 12, the thumb disk screws 17 are screwed into the counter sunk nuts 16. The control panel 15 is permanently attached to the main body section 12. The slide guide 14 is permanently mounted to the bottom side of the main body section 12. The bottom section 13 is secured to the main body section 12, by using one thumb disk screw 17. The thumb disk screw 17 is passed through the slot that is cut into the mounting face on the bottom section 13 and screwed into a countersunk nut 16. The slot enables the bottom section 13 to moved forward and rearward, while the slide guide 14 maintain the parallel and perpendicular position of the bottom section 13.

Figure 8:
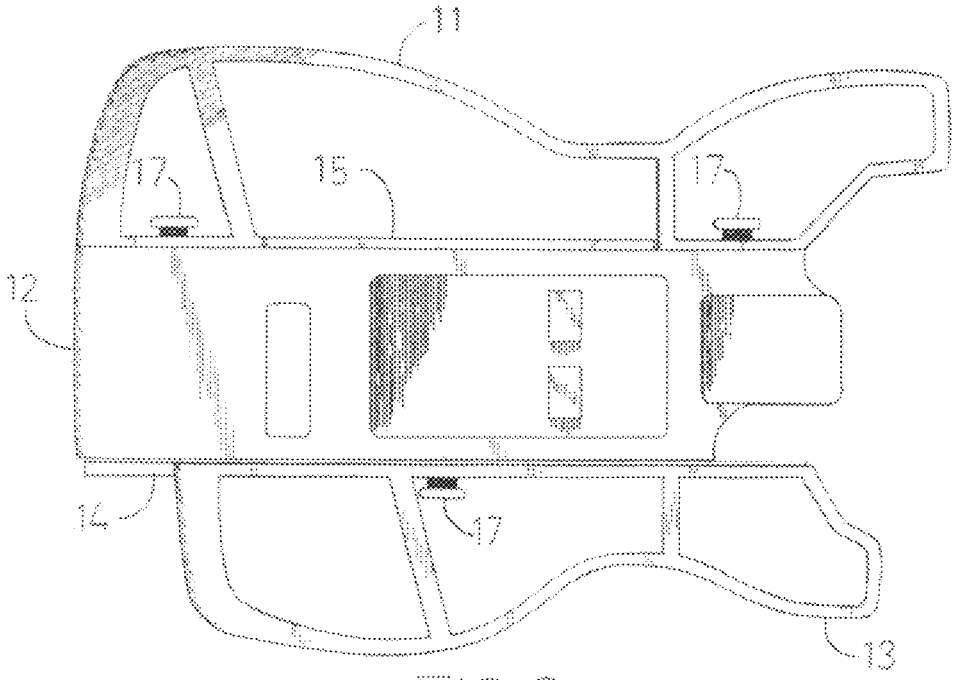
FIG. 8 shows the front plan view of the guitar body in it's assembled state according to a preferred embodiment of the present invention. This view displays the bottom section in it's forward position.

FIG. 8 is the front plan view of the guitar body in it's assembled state. This view displays the bottom section in it's forward position. By simply loosening the bottom section 13's thumb disk screw 17, the bottom section can be slid forward. This allows the guitar to come back to the performer, while it can rest on the performers leg or knee.

Figure 9:
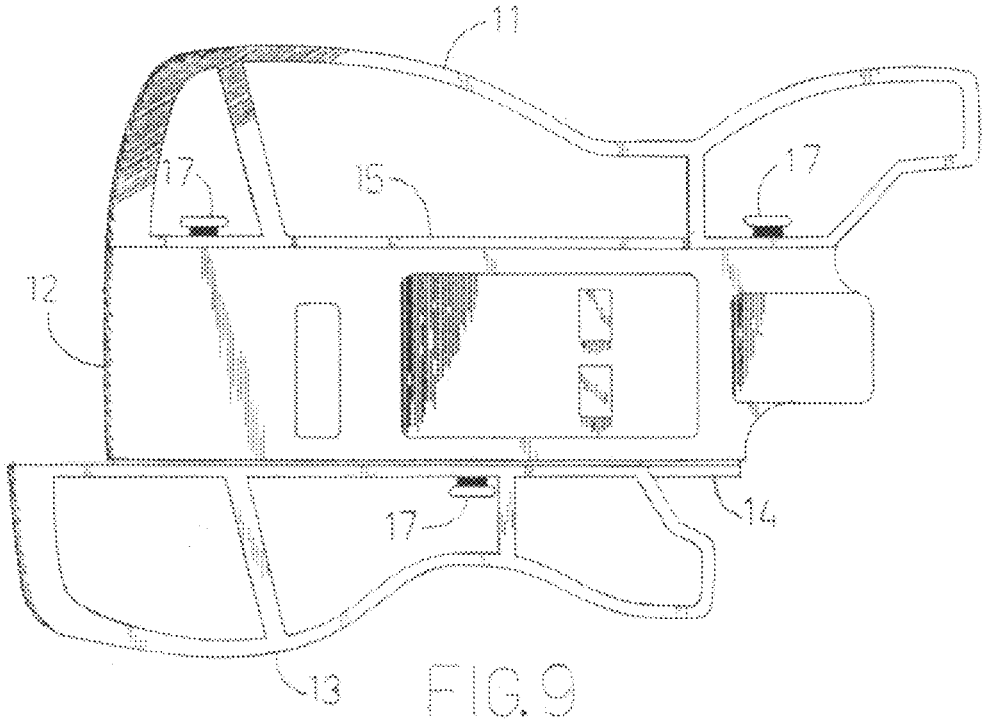
FIG. 9 shows the front plan view of the guitar body in it's assembled state according to a preferred embodiment of the present invention. This view displays the bottom section in it's rearward position.

FIG. 9 is the front plan view of the guitar body in ifs assembled state. This view displays the bottom section in it's rearward position. By simply loosening the bottom section 13's thumb disk screw 17, the bottom section can be slid rearward. This allows the guitar to move away from the performer, while it can rest on the performers leg or knee.

What is claimed is:

1. A travel guitar comprising:

a body and a neck, the body comprising two detachable sections, said detachable sections being a top section and a bottom section; the bottom section, is designed to rest on a performer's leg or knee, and is adjustable through sliding longitudinally between a more forward and rearward position, and secured by using any type of tool free fastener.

* * * * *